United States Patent [19]

Babin et al.

[11] Patent Number: 5,074,122

[45] Date of Patent: Dec. 24, 1991

[54] AIR-CONDITIONING SYSTEM FOR A RAILROAD TRAIN

[75] Inventors: James Babin, Sartrouville; Georges Debresie, Domont, both of France

[73] Assignee: Faiveley Transport, Saint-Ouen Cedex, France

[21] Appl. No.: 519,105

[22] Filed: May 3, 1990

[30] Foreign Application Priority Data

May 10, 1989 [FR] France ..... 89 06109

[51] Int. Cl.[5] ..... F25B 39/04; B60H 1/00

[52] U.S. Cl. ..... 62/183; 62/239; 62/295; 62/296; 62/428; 165/41

[58] Field of Search ..... 62/239, 241, 242, 244, 62/428, 295, 296, 506, 507, 181, 183, 184, 150, DIG. 17; 165/41, 42, 43, 44

[56] References Cited

U.S. PATENT DOCUMENTS

| | | | |
|---|---|---|---|
| 1,769,119 | 7/1930 | Davenport | 62/183 X |
| 1,886,607 | 11/1932 | Van Deventer | 62/181 |
| 2,100,834 | 11/1937 | Chapman | 62/507 X |
| 2,111,905 | 3/1938 | Smith, Jr. et al. | 62/152 |
| 2,150,076 | 3/1939 | Neubauer et al. | 62/295 X |
| 3,218,820 | 11/1965 | Spatt | 62/295 X |
| 3,785,167 | 1/1974 | Sahs | 62/296 |
| 3,853,174 | 12/1974 | Kramer | 62/181 X |
| 4,905,478 | 3/1990 | Matsuda et al. | 62/428 X |

FOREIGN PATENT DOCUMENTS

| | | | |
|---|---|---|---|
| 0187906 | 7/1986 | European Pat. Off. . | |
| 0221913 | 9/1987 | Japan | 62/241 |
| 396966 | 1/1966 | Switzerland . | |

*Primary Examiner*—Harry B. Tanner

*Attorney, Agent, or Firm*—Young & Thompson

[57] ABSTRACT

A compression-type air-conditioning system for a railraod car, intended in particular for a high-speed train, includes a refrigerant compressor, a condenser with tubes in which compressed fluid is cooled by circulation of air around the tubes and is thereafter liquified, an expansion valve supplying a low-temperature refrigerating gas, and an evaporator following the expansion valve. The tubes of the condenser form an oblique bank between a floor of the railroad car and an underframe of the air-conditioning system. The oblique bank enables, on the one hand, the number of the tubes and consequently the cooling capacity of the air-conditioning system to be increased. On the other hand, space is freed up in a vertical direction for fitting damping devices at different fastening points on the condenser. As a result of the invention, there is an improvement in the comfort of passengers, both in terms of air-conditioning and in terms of reducing vibrations. Furthermore, there is a reduction in operating costs.

6 Claims, 2 Drawing Sheets

AIR-CONDITIONING SYSTEM FOR A RAILROAD TRAIN

BACKGROUND OF THE INVENTION

1. Field of the Invention

The present invention relates to a compression air-conditioning system for a railroad car, intended in particular for a high-speed train.

2. Description of Related Art

In general, a compression air-conditioning system of this type chiefly comprises:

a compressor into which a refrigerant is admitted, compressed and expelled under pressure into a downstream circuit;

a condenser, connected to the outlet of said compressor and in which the refrigerant is cooled by the air issuing from motor fans, which causes it to liquefy;

an expansion valve followed by an evaporator, in which the refrigerant, having been subjected to a relatively very low pressure, vaporizes, which causes its temperature to be lowered and the desired cooling to be produced;

a circuit returning the gaseous refrigerant to the inlet of the compressor after it has passed through an air-treatment unit in which it is reloaded with heat.

The air-conditioning system is usually situated beneath the floor of the car, in a limited space between this floor, a wall parallel to this floor and lateral and transverse walls, said lateral walls being provided with openings for the inlet and outlet of the cooling air.

The condenser in such a system functions under a relatively high pressure corresponding to the condensation pressure of the refrigerant, whereas the evaporator functions under a relatively low pressure corresponding to the evaporation pressure of the fluid. The high-pressure circuit is connected to the low-pressure circuit, on the one hand, by the compressor and, on the other hand, by the expansion valve.

Various disadvantages have been noted in trains equipped with such systems:

in certain atmospheric conditions (snow, frost, etc.), it may be observed that the blades of the motor fans ice up, which can cause the entire system to come to a standstill, and yet the surrounding cold could enable the system to function with a reduced number of motor fans, or even with no fans at all, without risking damage to the equipment;

the increase of the heat loads, during a long period of sunshine or with a very high number of occupants, does not enable the desired comfort in terms of temperature to be ensured, given the limitation of the space available for the air-conditioning system;

the compressor-condenser unit generates vibrations which are a nuisance, in particular for the comfort of the passengers. This disadvantage is further amplified with the increase in the speed of the trains, which is desired by rail passenger carries, and in view of which the moving masses are reduced, as this reduction enables higher speeds to be attained for an equivalent moving force. Lightening the structures, however, makes them more sensitive to the vibrations which are felt by the passenger magnified at the level of the floor and the seat, which reduces the level of comfort.

In this type of system, a reduction of the vibrations is made difficult by the fact that a refrigerating compressor is necessarily connected to the high-pressure circuit by a rigid pipework which is required by the nature of the (refrigerant) fluid conveyed and by the high pressure. The result of this in practice is that the vibrations of the moving mechanical element which forms the compressor are transmitted to the whole refrigerating circuit.

Furthermore, the strict limitation on the space available for the system makes it impossible for the conventional shock-absorbing systems to be fitted to it.

In this respect, it should be pointed out that, in existing cars where the system is located in the lower part of the car, immediately below the body, the tubes of the condenser in which the refrigerant liquefies are arranged horizontally between, on the one hand, the floor of the body and, on the other hand, a plane wall parallel to this floor and integral with the latter. At their ends, the tubes are fixed to two vertical parallel plates in which these ends are regularly distributed. Furthermore, horizontal plates forming fins are arranged at regular intervals between the tubes so as to channel the air flow produced by one or more horizontal-axis fans. The assembly of the tubes of the condenser thus forms one or more banks of tubes, these banks being traversed by a flow of cooling air.

However, because of the limitation on the available space, in particular in the vertical direction relative to the floor of the car, assumed to be horizontal, the cooling capacity of the system is itself limited, which may have an adverse effect on the comfort of the passengers.

SUMMARY OF THE INVENTION

The object of the present invention is to overcome, at least partially, the various abovementioned disadvantages.

The subject of the present invention is a compression type air-conditioning system for a railroad car, intended in particular for a high-speed train, comprising:

a refrigerant compressor;

a condenser comprising tubes in which the compressed fluid is cooled by the circulation of the air around the tubes and liquefied;

an expansion valve followed by an evaporator, supplying a low-temperature refrigerating gas, this air-conditioning system being situated beneath the floor of the body of the car, in a space defined by this floor, a wall parallel to this floor and lateral walls, said lateral walls being provided with openings for the inlet and outlet of the cooling air, wherein the condenser comprises at least one bank of tubes which is arranged obliquely relative to the floor.

As a result of the oblique arrangement of the banks of tubes, a high-capacity condenser can be installed in a space with a reduced height and the cooling capacity of the whole system can consequently be increased within the same proportions.

Knowing that the lower horizontal wall of the car must be situated at a minimum height from the track, if it is desired to increase the vertically available space for the air-conditioning system, it will be necessary to raise the floor and ultimately the center of gravity and the height of the cars, with the known unfavorable consequences in mechanical, aerodynamic and energy terms. The invention avoids this need to raise the floor.

The oblique arrangement of the tubes of the condenser admittedly presents a priori an unfavorable aspect when taken with the fact that, the flow of cooling air being substantially horizontal, the flow rate of air supplied to each unit surface area of the oblique bank is less than that corresponding to the unit surface area of the bank which is assumed to be vertical. Calculations show, however, that the resulting reduction in heat exchanges may be negligible compared to the rise associated with the increase in the transverse dimension of the bank.

In terms of acoustics, it may be noted that, since the fins separating the tubes are no longer horizontal and are consequently no longer parallel to the flow of incident air, they perform the role of baffles for this flow, which reduces the level of the sound phenomena associated with this passage of air. This aspect concerns above all people situated outside the car and near to it: passengers on the station platforms, car maintenance staff, and others similarly situated.

Moreover, it is a priori less easy to connect a condenser which is oriented obliquely relative to the substantially horizontal surfaces of the floor and of the wall arranged beneath this floor, especially if one takes into consideration the stresses resulting from the vibrations and jolts occurring in a car pulled at high speed.

As a result of a second aspect of the invention, however, taken with the first aspect consisting in the obliqueness of the condenser, a space is freed in the vertical direction in the area of the condenser, and some of the dead zones thus created are used to install shock dampers at the points where the condenser is fastened to the floor of the body of the car.

According to the invention, these dampers preferably consist of blocks of resilient materials, for example rubber, having a vibrating frequency, on the fundamental or harmonic level, far apart from the resonant frequency of the body of the car.

According to another aspect of the invention, also aimed at reducing or preventing the transmission of the vibrations from the air-conditioning system to the body of the car, the high-pressure circuit comprises, at the outlet of the compressor, an expansion trap provided with a baffle arrangement allowing the circulation of the lubricating oil, the volume of said expansion trap being calculated for a vibrating frequency far apart from that of the body.

According to another aspect of the invention, so as to prevent, during particular atmospheric circumstances, the motor fans of the condenser icing up or being blocked up by snow, and causing the entire air-conditioning system to come to a standstill, these motor fans are each provided with a casing having, in its bottom part, a heat sensor which, when it detects a temperature which is close to or below zero degrees Centigrade, causes the corresponding motor fan to come to a standstill. It is, of course, possible to mount the heat sensors in series so that the triggering of one of them causes all the motor fans to come to a standstill, without causing the remainder of the air-conditioning system to come to a standstill.

In these conditions of a surrounding low temperature, it will be possible for the cooling of the condenser to be sufficient without the help of the flow of cooling air coming from the motor fans and this will be all the more so since, as a result of the first aspect of the invention, the overall cooling capacity being increased, the heat load will be proportionally less great.

Other features of the invention will emerge from the description below.

BRIEF DESCRIPTION OF THE DRAWINGS

In the attached drawings, given by way of non-limiting examples.

DESCRIPTION OF THE PREFERRED EMBODIMENT

Figure 1:
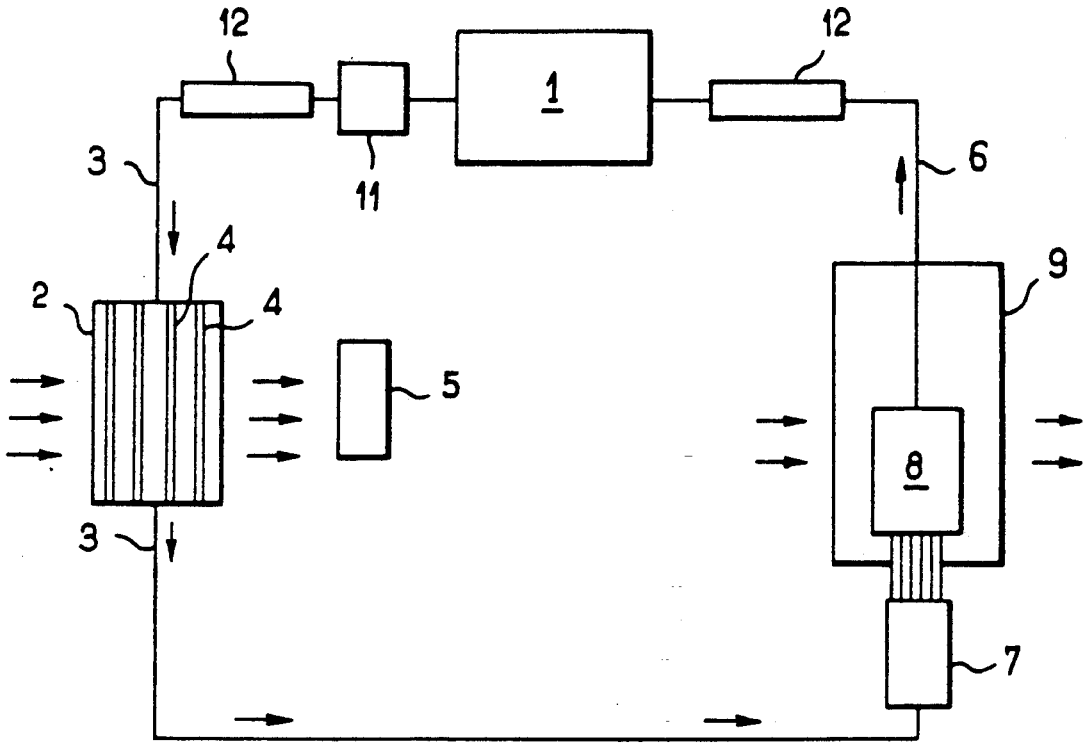
FIG. 1 shows a simplified diagram of an air-conditioning system for a railroad car, according to the invention.

The functioning of an air-conditioning system according to the invention will be described at the same time as the embodiment shown in FIGS. 1 to 4.

A refrigerant compressor 1 (see FIG. 1) is connected to a condenser 2 by a high-pressure duct 3.

The condenser 2 comprises tubes 4 in which the refrigerant circulates under pressure. The tubes 4 are cooled by a flow of air, indicated by parallel arrows in FIG. 1, this flow of air being produced by one or more motor fans 5. The cooling of the refrigerant maintained under pressure causes it to liquefy in the condenser 2. At the outlet of the latter, the refrigerant is brought by the high-pressure duct 3 to an expansion valve 7 in which it is expanded before passing into an evaporator 8 in which it vaporizes, which causes its temperature to be lowered considerably. The evaporator 8 is itself situated in a chamber 9 where the treatment of the air of the car is performed and which serves, in particular, for extracting the excess heat from this air by heat exchange with the refrigerant gas. After this heat exchange, the refrigerant gas returns via duct 6 to the compressor 1.

In FIG. 1, an expansion trap 11 according to the invention (see FIG. 4) has also been indicated at the high-pressure outlet of the compressor 1 and, on either side of the compressor, two flexible connection-pipe elements 12 have been shown which are made from a material enabling them to work in torsion so as to be able to sustain certain jolts originating from the compressor, in particular when it is started up.

Figure 2:
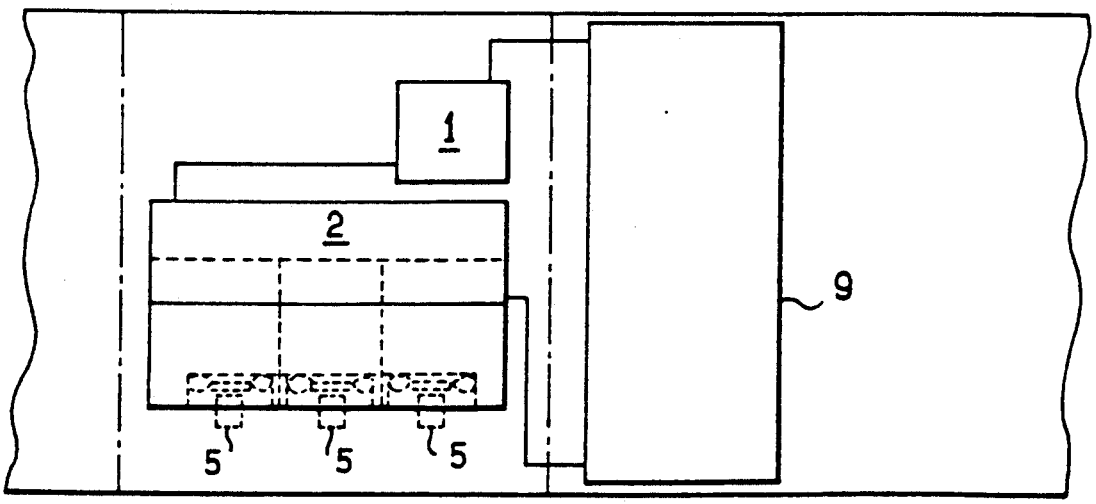
FIG. 2 is a plan view of the lower part of a car, the floor having been removed, showing the general arrangement of an air-conditioning system according to the invention.

In FIG. 2, the relative position of several of the main subassemblies of an air-conditioning system according to the invention has been indicated schematically. The flow of air for cooling the refrigerant is created by the suction of the fans 5. So as to improve the overall heat balance, the sucked-in flow of air first cools the compressor 1 and then passes through the tubes of the condenser 2 before flowing through the chamber 9.

Figures 3, 4:
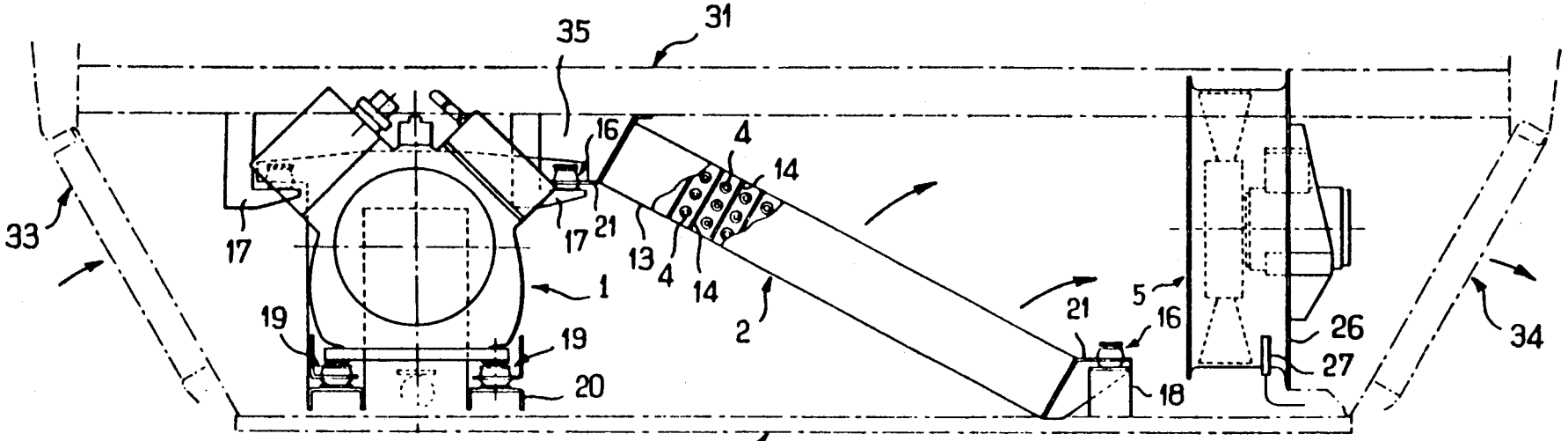
FIG. 3 is a view in cross-section, on a larger scale, of an air-conditioning system according to the invention.
FIG. 4 is a schematic view of an expansion trap for an air-conditioning system according to the invention.

The transverse arrangement, relative to the car, of certain subassemblies, as well as of the orientation of the flow of cooling air, appears more plainly in FIG. 3.

The system is placed, in the lower part of the car, between a floor 31 and a substantially horizontal wall 32 fastened to this floor 31 by known means, not shown.

The cooling air penetrates through openings in a lateral wall 33 and exits by openings in a lateral wall 34 opposite the former.

The condenser 2 comprises a casing 13, connected tightly to the floor 31 and to the horizontal wall 32. In FIG. 3, the casing 13 is shown partially cut away, which allows the arrangement of the tubes 4 containing the refrigerant to be seen. These tubes 4 are separated by fins 14 whose plane surface forms an angle with the incident direction, substantially horizontal, of the flow of cooling air. The fins 14 perform the role of baffles relative to the flow of incident air and partially reflect the sound waves propagating with the air, thus attenuating the sound level transmitted to the outside of the car.

It can also be seen in FIG. 3 that the inclination of the banks of tubes 4 forming the condenser 2 enables space to be freed in the vertical direction, in particular dead spaces 35, in which shock-absorbing systems 16 are to be positioned, resting on supports 17, 18 integral with the walls 31, 32 respectively, which are themselves integral with the body of the car.

The casing 13 is fixed to the damping systems 16 which are here formed by rubber blocks, via flanges 21.

The dampers 16 underneath the floor 31 also contribute to damping the vibrations of the compressor 1 by adding their effects to those of dampers 19 placed at the base of the compressor 1 on supports 20. A twin suspension is thus formed for the compressor 1 which is significantly more efficient from the point of view of damping the vibrations which originate there.

The expansion trap 11, shown schematically in FIG. 4, is connected to the HP outlet of the compressor 1 and is arranged close to the latter. Its volume is determined so as not to transmit frequencies corresponding to the resonant frequency of the body, for example between 25 and 250 Hz.

The expansion trap 11 is designed so as to enable the collection and flow-off of droplets of oil from the lubricating oil of the compressor 1. These droplets are carried along by the refrigerant to the outside of the compressor. For this purpose, the trap 11 has a lower wall 23 arranged as the extension of the lower walls of the inlet conduit and of the outlet conduit. The trap 11 furthermore has baffles 22 provided with orifices 24 which are arranged such that, near the wall 23, there is no obstacle to the circulation of the droplets of oil carried along by the refrigerant.

In FIG. 3, a part of the safety system has been shown which is intended to bring the motors of the fans 5 to a standstill when there is a risk of the blades being blocked up due to icing or due to the accumulation of snow in their clearance space; the system is designed such that this standstill does not cause the remainder of the air-conditioning system to come to a standstill.

For this purpose, each motor fan 5 has a casing 26, the bottom part of which receives a heat sensor 27 adjusted so as to produce a disengaging of the motor fan 5 when the external temperature reaches a value which is close to or below zero degrees Centigrade without bringing the remainder of the air-conditioning system to a standstill. The various heat sensors 27 are preferably mounted in series in the conventional manner such that the triggering of just one of them causes all the motors of the fans 5 to come to a standstill but without causing the remainder of the air-conditioning system to come to a standstill.

Some numerical data corresponding to an embodiment of an air-conditioning system according to the invention will be given hereinbelow by way of non-limiting example.

The compressor 1 rotates at 1,500 r/min, which corresponds to a fundamental frequency of 25 Hz and to harmonics which may coincide with the resonant frequency of a railroad car body, generally between 25 and 250 Hz.

The usable height beneath the floor 31 of the car (between this floor 31 and the underframe 32 of the air-conditioning system) is, for example, 600 mm. The number of substantially horizontal tubes 4, approximately 1,900 mm in length, forming a bank inside the condenser 2 may be calculated therefrom. Since the transverse pitch of these tubes 4 has a standardized value of 25.4 mm, the number of tubes 4 of a single bank, arranged vertically, is in practice 22.

By orienting the condenser 2 obliquely, with an angle of approximately 30 degrees relative to the horizontal plane, the available height becomes 920 mm, which corresponds in practice to 35 tubes, for a single bank of tubes, i.e. an increase of more than 50% as compared to the 22 tubes of a vertically arranged condenser.

Although the flow rate of air per unit surface area of the bank of tubes 4 is slightly decreased, as the value of this flow rate is not critical for the cooling efficiency of the system, the heat power of the latter will be increased by approximately 50%.

Moreover, as the speed V of the air close to the tubes 4 will be reduced, the head loss of the air will be substantially reduced since it is a function of the square of the speed V, which will further relieve the work of the motor fans 5 and also will enable the ventilation noise conveyed by these motor fans 5 to be reduced.

This advantage is in addition to that given by the inclination of the fins 14 placed between the tubes, which enables the fins 14 to play the role of traps for the sound waves conveyed by the cooling air.

As another non-limiting example, in the case of a condenser 2 inclined such as hereinabove, for a thermodynamic cycle between +8° C., the evaporation temperature of the refrigerant, and +65° C., the condensation temperature of this fluid, the heat powers may be, respectively:

condenser : 60 kW;
evaporator: 40 kW;
compressor: 20 kW.

The invention is not, of course, limited to the exemplary embodiments which have just been described and numerous modifications may be made to them without going beyond the scope of this invention.

Instead of an angle of approximately 30° for the condenser, a different angle between 25° and 45° could, for example, be taken.

Moreover, the arrangement of the tubes 4 and of the fins 14 inside the condenser 2 may be different from that shown in FIG. 3.

Indeed, the tubes 4 may also be staggered relative to each other, these tubes being separated from each other by fins which extend in a direction perpendicular to that of the fins 14 shown in FIG. 3.

We claim:

1. A compression air-conditioning system for a railroad car, intended in particular for a high-speed train, comprising:

a refrigerant compressor (1);

a condenser (2) comprising tubes (4) in which compressed fluid is cooled by circulation of air around the tubes (4) and liquefied;

an expansion valve (7) for supplying a low-temperature refrigerating gas, said system being situated in a lower part of the car, beneath a floor (31) of a body of the car, in a space defined by the floor, a wall (32) substantially parallel to the floor, and lateral walls (33, 34), said lateral walls being provided with openings for the inlet and outlet of the cooling air;

there being at least one bank of said tubes(4) which is arranged obliquely relative to the floor (31); and wherein some dead spaces (35) thus freed at ends of said obliquely arranged bank of tubes (4) are used for fitting damping systems (16) at points where the condenser (2) is fastened to the floor (31) of the body of the car.

2. The system as claimed in claim 1, wherein the tubes (4) of the condenser (2) form a bank inclined relative to the floor (31) of the car by an angel between 25° and 45°

3. The system as claimed in claim 1, wherein an expansion trap (11), whose volume is determined so as not to transmit frequencies between 25 and 250 Hz, is arranged on a high-pressure pipework at an outlet of the compressor (1).

4. The system as claimed in claim 1, wherein, near the compressor (1), an inlet circuit and an outlet circuit each comprise an element (12) made from a material enabling it to work in torsion so as to be able to sustain certain jolts originating from the compressor (1), in particular when it is started up.

5. The system as claimed in claim 1, wherein circulation of cooling air around the tubes (4) of the condenser (2) is accelerated by a plurality of motor-driven fans (5) each having blades that are surrounded by a casing (26) accommodating, in its lower part, a heat sensor (27) adjusted so as to be triggered when external temperature reaches a value close to or below zero degrees Centigrade, thus causing a motor of each of the motor fans to come to a standstill.

6. The system as claimed in claim 5, wherein the hat sensor (27) of the motor fans (5) are mounted in series such that triggering of just one of the motor-driven fans (5) causes all motors of the motor-driven fans (5) to come to a standstill without bringing the remainder of the air-conditioning system to a standstill.

* * * * *